US012673841B2

(12) United States Patent
Lair et al.

(10) Patent No.: US 12,673,841 B2
(45) Date of Patent: Jul. 7, 2026

(54) BLANKING STATION AND FLEXIBLE GUIDE FOR GUIDING BLANKS IN A BLANKING STATION

(71) Applicant: BOBST MEX SA, Mex (CH)

(72) Inventors: Tim Lair, Bussigny (CH); Paulo Ferreira, Daillens (CH)

(73) Assignee: BOBST MEX SA, Mex (CH)

( * ) Notice: Subject to any disclaimer, the term of this patent is extended or adjusted under 35 U.S.C. 154(b) by 58 days.

(21) Appl. No.: 18/716,255

(22) PCT Filed: Dec. 16, 2022

(86) PCT No.: PCT/EP2022/086449

§ 371 (c)(1),
(2) Date: Jun. 4, 2024

(87) PCT Pub. No.: WO2023/117791

PCT Pub. Date: Jun. 29, 2023

(65) Prior Publication Data

US 2025/0033918 A1 Jan. 30, 2025

(30) Foreign Application Priority Data

Dec. 21, 2021 (EP) ..... 21216606

(51) Int. Cl.
*B65H 31/32* (2006.01)
*B65H 31/34* (2006.01)

(52) U.S. Cl.
CPC ..... *B65H 31/32* (2013.01); *B65H 31/34* (2013.01); *B65H 2404/74* (2013.01)

(58) Field of Classification Search
CPC ..... B65H 31/34; B65H 31/32; B65H 31/26; B65H 2404/74; B26D 7/18
See application file for complete search history.

(56) References Cited

U.S. PATENT DOCUMENTS 3,285,607 A * 11/1966 Lindemann ..... B65H 31/34 271/217
6,102,268 A * 8/2000 Raveleau ..... B26D 7/1818 225/97

(Continued)

FOREIGN PATENT DOCUMENTS

| | | | |
|---|---|---|---|
| CN | 106218954 | A | 12/2016 |
| JP | 3148971 | U | 3/2009 |
| TW | M382283 | U | 6/2010 |

*Primary Examiner* — Andrew M Tecco
(74) *Attorney, Agent, or Firm* — Bookoff McAndrews, PLLC

(57) ABSTRACT

The invention relates to a blanking station comprising a blanking tool (12), at least one blank receiving unit (14, 16) for receiving and piling of blanks (20) in a blank collecting space (22) in a piling direction, and at least one flexible guide (18), located between the blanking tool (12) and the receiving unit (14, 16), wherein the flexible guide (18) comprises at least one guiding surface (32) adapted for guiding the blanks (20), being oriented in parallel to the piling direction and arranged so as to define an outer contour of the blank collecting space (22), and wherein the flexible guide (18) further comprises at least one flexible portion (28), located in proximity to the blank receiving unit (14, 16), wherein the flexible portion (28) is elastically deformable in a first direction along the outer contour of the blank collecting space (22) and wherein the flexible portion (28) has a lower stiffness in the first direction than in a second direction perpendicular to the outer contour of the blank collecting space (22) to avoid deflection of the flexible portion (28) into the blank collecting space (22) in case of collision with a blank receiving unit (14, 16). Furthermore, the invention relates to a flexible guide for guiding blanks (20) in a blanking station (10).

7 Claims, 4 Drawing Sheets

(56) References Cited

U.S. PATENT DOCUMENTS

| | | | | |
|---|---|---|---|---|
| 6,997,363 | B1 * | 2/2006 | Vossen | B26D 7/1818 225/93 |
| 7,185,797 | B2 * | 3/2007 | Oetlinger | F16B 7/048 225/104 |
| 10,391,661 | B2 * | 8/2019 | Jakob | B26D 7/1818 |
| 10,562,729 | B2 * | 2/2020 | Ando | B65H 29/52 |
| 2008/0054551 | A1 * | 3/2008 | Obuchi | B65H 31/34 271/220 |
| 2018/0169884 | A1 * | 6/2018 | Jakob | B26D 7/1818 |
| 2018/0229958 | A1 * | 8/2018 | Ando | B65H 31/10 |

* cited by examiner

BLANKING STATION AND FLEXIBLE GUIDE FOR GUIDING BLANKS IN A BLANKING STATION

CROSS-REFERENCE TO RELATED APPLICATION(S)

This application is a National Stage Application under 35 U.S.C. § 371 of International Application No. PCT/EP2022/086449, filed on Dec. 16, 2022, which claims priority to European Application No. 21216606.0, filed on Dec. 21, 2021, the entireties of which are incorporated herein by reference.

The invention relates to a blanking station. Furthermore, the invention relates to a flexible guide for guiding blanks in a blanking station.

Blanking stations are typically applied in sheet processing machines, used for example in the packaging industry for processing raw materials like cardboard, paper or foils, into intermediate or finished products, typically in the form of blanks. The blanks are often collected in vertical piles on a blank receiving unit in a designated collecting space within the machine. To ensure that all blanks within such pile are well aligned, guiding elements defining an outer contour of the blank collecting space are applied. When a pile of blanks reaches a certain height, it is evacuated from the machine. This requires the receiving unit to move with respect to the guiding elements.

Furthermore, many modern high throughput machines are able to evacuate a finished pile of blanks from the machine without stopping the blanking process. New blanks, which are processed during evacuation of the pile, may be collected on a temporary receiving unit. In such case, both the blank receiving unit as well as the temporary receiving unit have to move with respect to the guiding elements.

As the guiding elements are typically located in close proximity to the receiving unit or temporary receiving unit, there is a risk of collision between these elements, especially when the machine is set-up to cut a new blank-design and the position of the guiding elements is adjusted. A collision, however, may result in disturbed pile formation and/or even damage to the blanking station. To avoid such consequences, special care has to be taken when setting new blank designs, resulting is extended machine set-up times.

Therefore, there is a need for a means to avoid or to reduce complications in case of collisions of guiding elements and receiving units within blanking stations.

The object of the invention is solved by a blanking station comprising a blanking tool, at least one blank receiving unit for receiving and piling of blanks in a blank collecting space in a piling direction, and at least one flexible guide, located between the blanking tool and the receiving unit, wherein the flexible guide comprises at least one guiding surface adapted for guiding the blanks, being oriented in parallel to the piling direction and arranged so as to define an outer contour of the blank collecting space, and wherein the flexible guide further comprises at least one flexible portion, located in proximity to the blank receiving unit, wherein the flexible portion is elastically deformable in a first direction along the outer contour of the blank collecting space and wherein the flexible portion has a lower stiffness in the first direction than in a second direction perpendicular to the outer contour of the blank collecting space to avoid deflection of the flexible portion into the blank collecting space in case of collision with a blank receiving unit.

Due to the elastic deformability of the flexible portion, damage to the blanking station, such as plastic deformation of machine parts, is prevented in case of collision with the blank receiving unit. Furthermore, the stiffness difference in the first and second direction results in case of collision in a preferred deflection of the guide along the counter of the blank collecting space, thereby ensuring that the shape of the blank collecting space is preserved and the piling process of the blanks is not disturbed.

To increase the throughput, the blanking station preferably comprises two or more blank receiving units, wherein at least one of the two blank receiving units comprises a rack of movable rack swords for temporarily receiving and piling of blanks while the at least one other receiving unit is evacuating a pile of blanks from the blanking station, wherein the rack swords are movable in a direction perpendicular to the piling direction and wherein the flexible portion of the flexible guide is adapted to elastically deform in case of collision with a rack sword. This allows to continue the blanking process when evacuating finished piles of blanks from the blanking station. At the same time, in case the moving rack sword collides with the flexible guide, damage to the rack sword, for example by bending, can be prevented.

Preferably, the flexible portion of the flexible guide extends, seen from the blanking tool, beyond the upper surface of at least one rack sword. This ensures proper alignment of every single blank received by the rack of swords. Furthermore, the relative position of rack sword and guide element ensures that proper alignment of the blanks is maintained when the rack swords are moved away from the receiving position, in particular during transfer of the temporary pile to an evacuating receiving unit.

In a preferred embodiment, the rack swords are adapted to move in a direction parallel to the guiding surface of the flexible guide and perpendicular to the piling direction. In case of collision, the collision force acts in a direction along the outer contour of the blank collecting space, thereby ensuring that deflection into blank collecting space is avoided.

In one variant, the blanking station comprises at least one rigid guide with at least one guiding surface for guiding blanks being oriented in parallel to the piling direction. In many applications, only selected guide elements are in risk of colliding with other machine parts. It may therefore not be necessary to equip all guides with flexible portions. The combination of flexible and simple rigid guides allows a simpler and more cost efficient machine set-up.

In a simple arrangement, the guiding surface of the flexible guides is oriented perpendicularly to the guiding surfaces of the rigid guides. This setup is especially useful in combination with a rack of movable swords for temporarily receiving and piling of blanks. The flexible guides can be aligned at positions with increased risk of collision along the rack sword movement direction such that their guiding surface prevents misalignment of blanks perpendicular to the rack sword movement direction. At the same time, the rigid guides may be applied to prevent misalignment of blanks in rack word movement direction at positions with lower risk of collision.

In a further preferred embodiment, the blanking station comprises a plurality of rigid portions surrounding the blank collecting space, wherein at least one flexible portion is connected to at least one rigid portion. Making the guides from two portions allows applying the flexible portion on several different positions of the blanking station and/or in different blanking stations and/or in different sheet processing machines. Thus, fewer flexible portions are needed.

Furthermore, when a blanking process is finished, the blanking station can be stored without the flexible part, resulting in a decreased storage space.

The object of the invention is also solved by a flexible guide for guiding blanks in a blanking station comprising at least one guiding surface adapted to restrict movement of blanks by direct contact with their edges, and a flexible portion, which is elastically deformable in a first direction, wherein the flexible portion has a lower stiffness in a first direction than in a second direction perpendicular to the first direction.

The advantages that were discussed for the blanking station also apply for the flexible guide.

Preferably, the flexible guide comprises a rigid portion and a flexible portion being connected to the rigid portion. More preferably, the flexible portion and the rigid portion are connected by a plug connection. This brings several advantages. The rigid portion allows a stable and well aligned attachment of the guide to the blanking station, for example by a screw connection. At the same time, the plug connection allows simple and fast exchange of the flexible portion.

In a preferred embodiment, the flexible portion consists of an abrasion resistant polymeric material. This allows the flexible guide to withstand multiple collisions without needing to be exchanged. In an example, the flexible guide is able to resist at least 1000 cycles of a rack sword impacting and deforming the flexible portion, losing at most 1 mm of material at the impact point.

Further advantages and features will become apparent from the following description of the invention and from the appended figures which show a non-limiting exemplary embodiment of the invention and in which:

FIG. 1 schematically shows a side view of a first embodiment of a blanking station with a blank receiving unit receiving and piling blanks;

FIG. 2 shows a side view of the blanking station of FIG. 1 with a rack of movable rack swords temporarily receiving and piling blanks;

FIG. 3 schematically shows front view of an embodiment of a flexible guide consisting of a rigid and a flexible portion;

Figure 6:
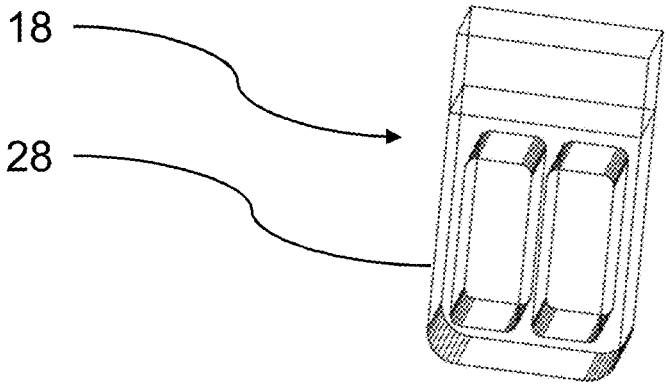
Figure 7:
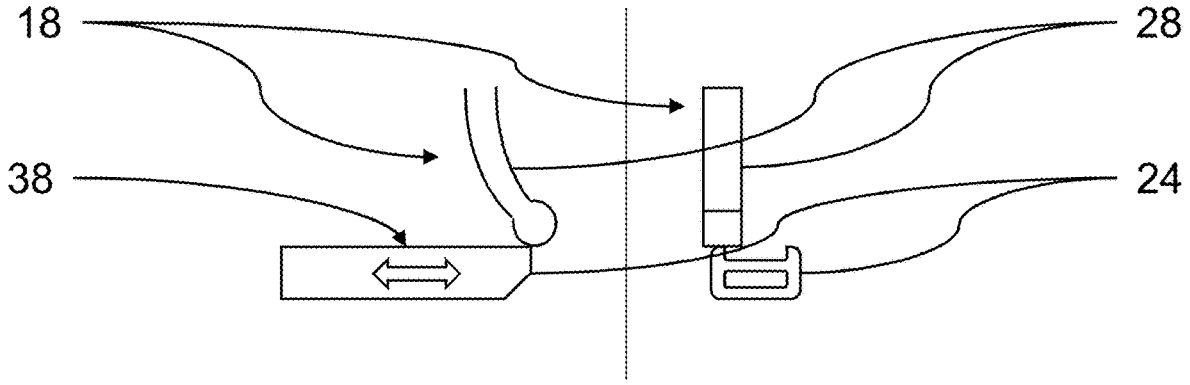
Figure 8:
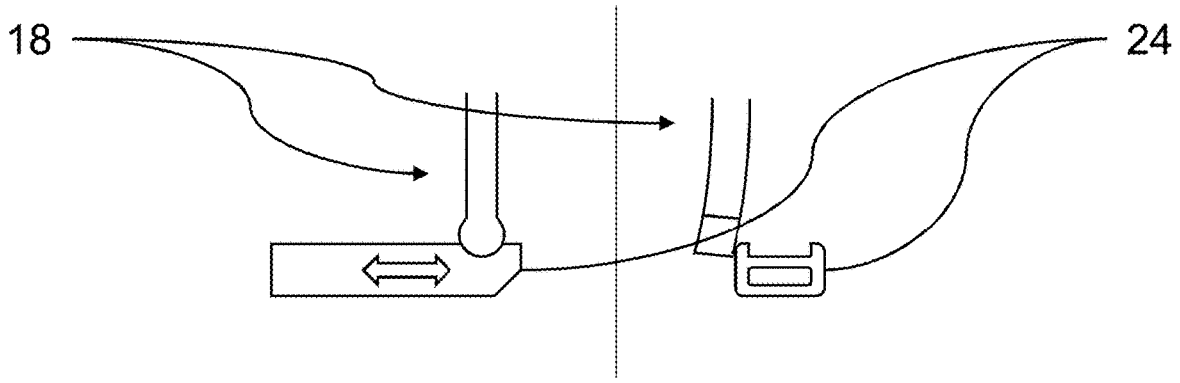
Figure 9:
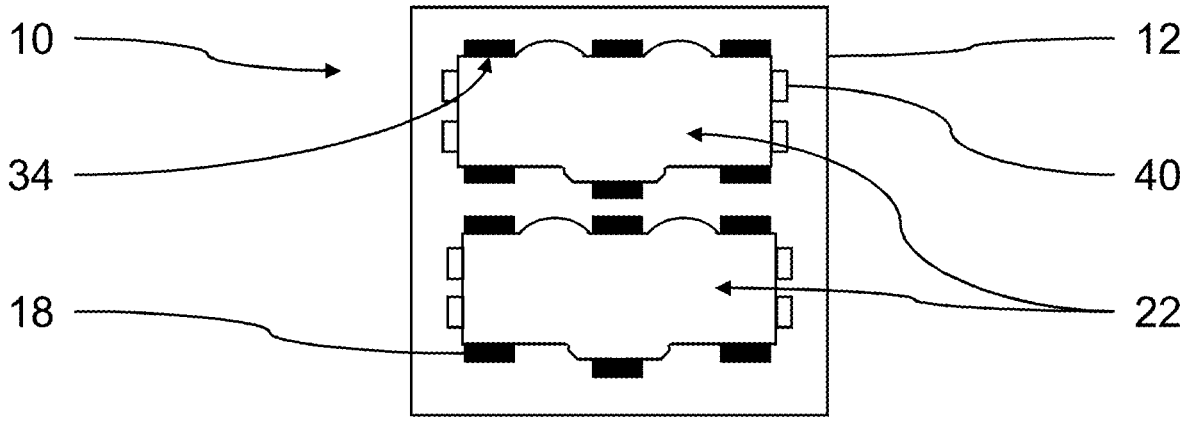
Figure 10:
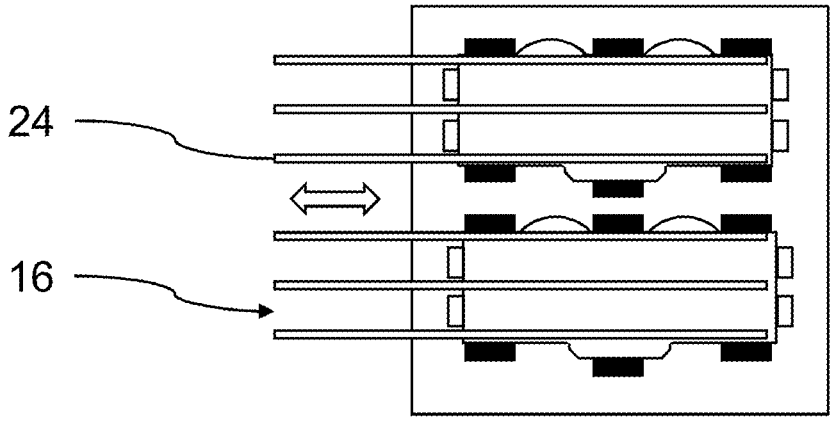

FIG. 6 schematically shows a front view of a second embodiment of a flexible guide;

FIG. 7 schematically shows a front and a side view of a collision induced deflection of a flexible guide in a first direction;

FIG. 8 schematically shows a front and a side view of a collision induced deflection of a flexible guide in a second direction;

FIG. 9 schematically shows a top view of an embodiment of a blanking station comprising rigid guides and flexible guides;

FIG. 10 shows another top view of the blanking station of FIG. 9 with a rack of movable rack swords in a blank receiving position.

Figure 1:
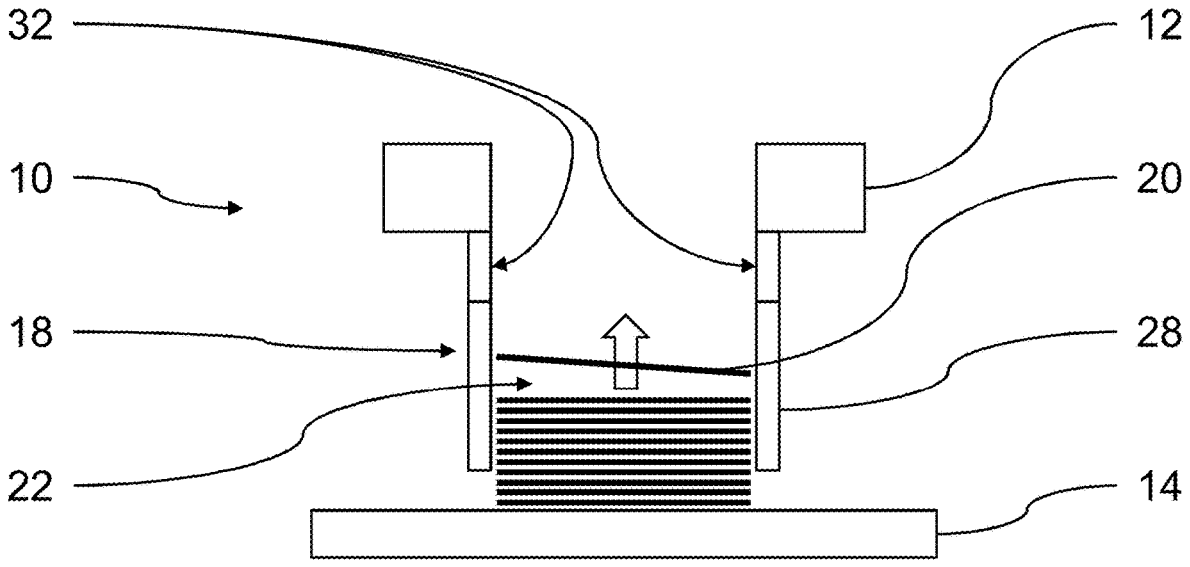
Figure 2:
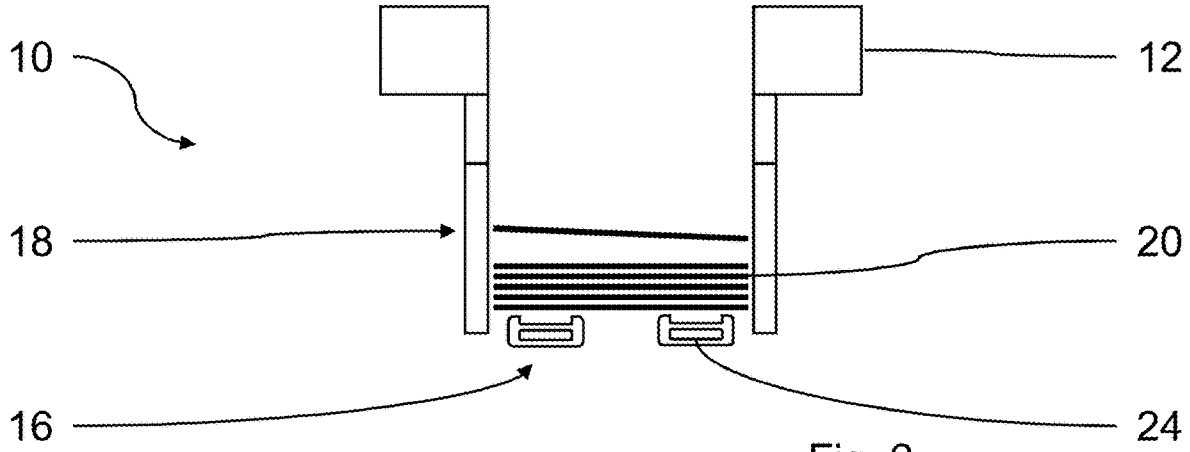

FIG. 1 and FIG. 2 schematically show a first embodiment of a blanking station 10 comprising a blanking tool 12, a first blank receiving unit 14, a second blank receiving unit 16, and multiple flexible guides 18, located between the blanking tool 12 and the receiving units 14, 16. For simplification, only two flexible guides 18 are depicted.

In the described embodiment, the first receiving unit 14 is a movable table adapted for receiving and piling of blanks 20 in a blank collecting space 22 in a piling direction (indicated with an arrow). The first receiving unit 14 is adapted to move opposite to the piling direction, thereby enabling the reception of blanks 20 on a growing pile always at the same position relative to the blanking tool 12.

The second receiving unit 16 is designed as a rack of swords 24 movable perpendicular to the piling direction and adapted for temporarily receiving and piling of blanks 20 while the first receiving unit 14 is evacuating a pile of blanks 20 from the blanking station 10. This allows to continue the blanking process even when the first receiving unit 14 evacuates a finished pile of from the blanking station 10.

Figures 3, 4, 5:
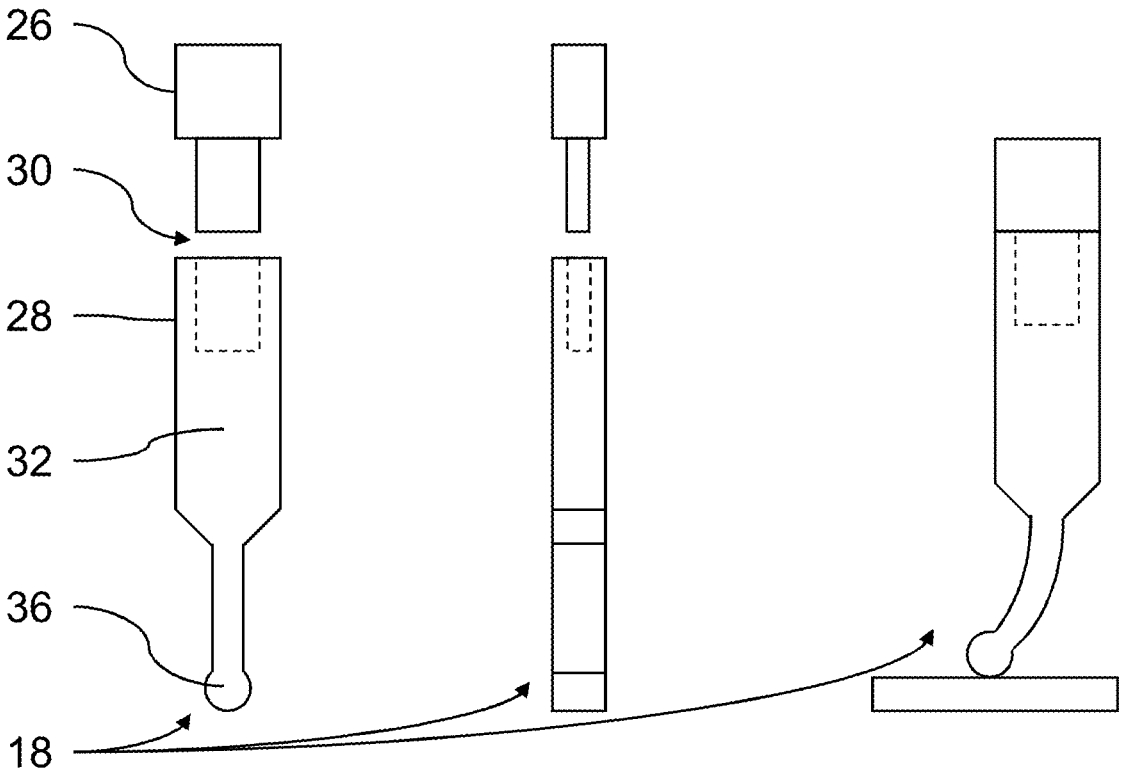
FIG. 4 shows a side view of the flexible guide of FIG. 3.
FIG. 5 shows another front view of the flexible guide of FIG. 3 with the flexible portion being deformed.

A detailed illustration of the flexible guides 18 is provided in FIG. 3, FIG. 4 and FIG. 5. In the described embodiment, the flexible guides 18 consist of a rigid portion 26 and a flexible portion 28 being attached to the rigid portion 26 by a plug connection 30. In other embodiments, the connection between both portions may be a clip, screw, bolt, glue or similar type of connection.

Both, the rigid 26 and the flexible portion 28 have at least one plane side. In connection, the plane sides of both portions form a flat guiding surface 32, which is adapted to restrict lateral movement of the blanks 20 by direct contact with the blank edges.

In the described embodiment, the rigid portions 26 of the flexible guides 18 are connected to the blanking tool 12 by a screw connection (not shown). Of course, the type of connection is only an example and should not limit the scope of the invention.

Seen from the blanking tool 12, the flexible guides 18 extend towards the blank receiving units 14, 16 such that the flexible portions 28 end in close proximity to the receiving units 14, 16.

The guiding surfaces 32 of the flexible guides 18 thereby define an outer contour 34 of the blank collecting space 22 between the blanking tool 12 and the blank receiving units 14, 16. The dimensions of the blank collecting space 22 depends on the blank shape and is specified by position of the guides 18.

The flexible portion 28 is made of a material, which is elastically deformable and at the same time abrasion resistant. Examples for such materials are natural or synthetic rubbers and/or polymers, such as Polytetrafluoroethylene, Elastomers and the like. Of course also other linear as well as non-linear elastic materials and/or bodies can be used.

FIG. 3 schematically shows a view on the guiding surface 32 of a flexible guide 18. For simplicity, this viewing direction is in the following referred to as "front view" direction. The viewing direction perpendicular to the guiding surface 32 is referred to as "side view" direction.

As shown in the front view of FIG. 3, the width of the flexible portion 28 is tapering from the side connecting to the rigid portion 26 towards the tip 36 of the flexible guide 18. The wider cross section at the point of attachment ensures sufficient holding force of the plug connection 30. The slimmer part close to the tip 36 enhances elastic deformability. In the described embodiment the flexible guide 18 has a bulged tip 36. This ensure that the shape and function of the flexible portion 28 is preserved during extended applications, even if collision induced abrasion occurs.

The side view of FIG. 4 reveals that the thickness of the flexible portion 28 is constant over its whole length. Of course the shape of the guide is only exemplary. In other embodiments, the thickness can vary over the length of the flexible guide 18.

The slimmer part of the flexible portion 28 is in front view direction (out of the viewing plane of FIG. 3/in the viewing plane of FIG. 4) thicker than in side view direction (in the viewing plane of FIG. 3/out of viewing plane of FIG. 4). This uneven dimensioning result in an anisotropic deformation behavior of the flexible portion 28. In particular, the flexible portion 28 has a higher stiffness in front view direction than in side view direction. In other embodiments it is also possible to achieve such stiffness differences by application of anisotropic materials, such as for example fiber reinforced polymers.

A schematic illustration of a flexible guide 18 with the flexible portion 28 being deformed in the privileged direction of lower stiffness is shown in FIG. 5.

Of course, the shape of the flexible guide 18 is not limited to the previous descriptions. In particular, flexible portions 28 with additional structural means, for example hollow and/or thin-walled geometries such as shown in FIG. 6 may be applied to enhance elastic deformability and/or stiffness anisotropy.

In the embodiment, the flexible guides 18 are aligned in the blanking station 10 such that the flexible portion 28 is elastically deformable in a direction along the outer contour 34 of the blank collecting space 22. In particular, the direction of lower stiffness of the flexible portion 28 is in line with the outer contour 34. At the same time, the direction of higher stiffness of the flexible portion 28 is perpendicular to the direction of the outer contour 34. Consequently, in case of collision with a blank receiving unit 14, 16, the flexible portion 28 preferentially deforms in direction along the outer contour 34 of the blank collecting space 22, thereby avoiding deflection into the blank collecting space 22.

The deformation behavior of the flexible guide 18 in case of collision with a moving rack sword 24 is shown in FIG. 7. Prior to collision, the flexible portion 28 of the flexible guide 18 extends, seen from the blanking tool 12, beyond the upper surface 38 the rack sword 24 to ensure proper alignment of temporarily piled blanks 20. In the embodiment, the rack sword 24 moves in a direction along the outer contour 34 of the blank collecting space 22 parallel to the guiding surface 32 of the flexible guide 18.

On the left side of FIG. 7, a front view of flexible guide 18 and impacting rack sword 24 is shown. The flexible portion 28 of the flexible guide 18 deforms in direction of the rack sword movement (indicated with an arrow) along the outer contour 34 of the blank collecting space 22. A side view of the flexible guide 18 and impacting rack sword 24 is shown on the right side of FIG. 7. Due to the anisotropic stiffness, deformation of the flexible portion 28 perpendicular to the rack sword movement direction is avoided, thereby preserving the integrity of the blank collecting space 22.

For comparison, FIG. 8 shows an unfortunate case, in which the attempt to avoid deflection of the flexible guide 18 into the blank collecting space 22 failed. The front (left) as well as the side view (right) of the flexible guide 18 provided in FIG. 8 show that the flexible portion 28 is deformed and deflected perpendicular to the movement direction of the rack sword 24. Such behavior could for example occur, if the stiffness differences in the individual directions of the flexible portion 28 are too small or if the flexible portion 28 extends, seen from the blanking tool 12, too far beyond the upper surface 38 of the rack sword 24. As a consequence, the flexible portion 28 of the flexible guide 18 may be deflected away from or into the blank collecting space 22, resulting in disturbed pile formation.

A second embodiment of a blanking station 10 according to the invention is shown in FIG. 9 and FIG. 10. The second embodiment corresponds in several essential features to the first embodiment, so that only the differences will be discussed below. Identical and functionally identical parts are provided with the same reference symbols.

Both, FIG. 9 and FIG. 10 provide an illustration on the blanking station 10 seen from the blanking tool 12. This view direction is referred to as "top view".

The blanking station 10 comprises a blanking tool 12, a first blank receiving unit 14, a rack of movable rack swords 24 forming a second temporary blank receiving unit 16, and multiple flexible 18 as well as rigid 40 guides, located between the blanking tool 12 and the blank receiving units 14, 16.

Both, flexible and rigid guides 18, 40 comprise rigid portions 26, being attached to the blanking tool 12. They are aligned such that they surround the blank collecting space 22, thereby defining its outer contour 34. Furthermore, both types of guides 18, 40 comprise a guiding surface 32 for guiding blanks 20 oriented in parallel to the piling direction.

In the described embodiment, the guiding surfaces 32 of the flexible guides 18 are oriented perpendicularly to the guiding surfaces 32 of the rigid guides 40.

In FIG. 10, the rack swords 24 are located in a blank receiving position. Their movement direction is indicated by an arrow. The rigid guides 40 are aligned with respect to the rack swords 24 such that the swords 24 can move through open spaces in between the individual rigid guides 40. Therefore, the risk of collisions is low.

Contrary to this, along the movement direction of the rack swords 24 there is significant risk collision. To reduce complications in case of collision and to ensure that deflection of the guides into the blank collecting space 22 is avoided, flexible guides 18 are applied.

The invention claimed is:

1. A blanking station comprising:

a blanking tool, at least one blank receiving unit for receiving and piling of blanks in a blank collecting space in a piling direction, and at least one flexible guide, located between the blanking tool and the receiving unit, wherein the flexible guide comprises at least one guiding surface adapted for guiding the blanks, being oriented in parallel to the piling direction and arranged so as to define an outer contour of the blank collecting space, and wherein the flexible guide further comprises at least one flexible portion, located in proximity to the blank receiving unit, wherein the flexible portion is elastically deformable in a first direction along the outer contour of the blank collecting space and wherein the flexible portion has a lower stiffness in the first direction than in a second direction perpendicular to the outer contour of the blank collecting space to avoid deflection of the flexible portion into the blank collecting space in case of collision with a blank receiving unit.

2. The blanking station according to claim 1, further comprising:

at least two blank receiving units, wherein at least one of the two blank receiving units comprises a rack of movable rack swords for temporarily receiving and piling of blanks while the at least one other receiving unit is evacuating a pile of blanks from the blanking station, wherein the rack swords are movable in a direction perpendicular to the piling direction and wherein the flexible portion of the flexible guide is adapted to elastically deform in case of collision with a rack sword.

3. The blanking station according to claim 2, wherein the flexible portion of the flexible guide extends, seen from the blanking tool, beyond the upper surface of at least one rack sword.

4. The blanking station according to claim 2, wherein the rack swords are adapted to move in a direction parallel to the guiding surface of the flexible guide and perpendicular to the piling direction.

5. The blanking station according to claim 1, further comprising at least one rigid guide with at least one guiding surface for guiding blanks, being oriented in parallel to the piling direction.

6. The blanking station according to claim 5, wherein the guiding surface of the flexible guide is oriented perpendicularly to the guiding surface of the rigid guide.

7. The blanking station according to claim 1, further comprising a plurality of rigid portions surrounding the blank collecting space, wherein at least one flexible portion is connected to at least one rigid portion.

* * * * *